United States Patent [19]

Kadowaki et al.

[11] 4,456,681

[45] Jun. 26, 1984

[54] COLOR PHOTOGRAPHIC MATERIALS

[75] Inventors: Takashi Kadowaki; Kaoru Onodera, both of Odawara, Japan

[73] Assignee: Konishiroku Photo Industry Co., Ltd., Japan

[21] Appl. No.: 498,640

[22] Filed: May 27, 1983

[30] Foreign Application Priority Data

May 28, 1982 [JP] Japan ..... 57-90834

[51] Int. Cl.[3] ..... G03C 1/46; G03C 1/84

[52] U.S. Cl. ..... 430/505; 430/507; 430/512; 430/552; 430/553; 430/554; 430/555; 430/556; 430/557; 430/558; 430/551

[58] Field of Search ..... 430/505, 507, 512, 552, 430/553, 554, 555, 556, 557, 558, 931, 551

[56] References Cited

U.S. PATENT DOCUMENTS

| | | | |
|---|---|---|---|
| 2,423,730 | 7/1947 | Salminen et al. | 430/473 |
| 3,253,921 | 5/1966 | Sawdeg | 430/512 |
| 3,533,794 | 10/1970 | Ohi et al. | 430/512 |
| 3,649,276 | 3/1972 | Sano et al. | 430/512 |
| 3,698,907 | 10/1972 | Sato et al. | 430/512 |
| 4,323,633 | 4/1982 | Beretta | 430/931 |

*Primary Examiner*—J. Travis Brown

*Attorney, Agent, or Firm*—Finnegan, Henderson, Farabow, Garrett & Dunner

[57] ABSTRACT

A color photographic material comprising on a support a first silver halide emulsion layer containing a yellow coupler, a second silver halide emulsion layer containing a magenta coupler, a third silver halide emulsion layer containing a cyan coupler, said third emulsion layer being positioned farthest from the support, a first non-light-sensitive layer formed on one side of said third emulsion layer opposite to the support, and a second non-light-sensitive layer formed on the other side of said third emulsion layer, at least said first non-light sensitive layer containing a UV absorber.

9 Claims, No Drawings

COLOR PHOTOGRAPHIC MATERIALS

BACKGROUND OF THE INVENTION

1. Technical Field

The present invention relates to color photographic materials. More particularly, the invention relates to photographic materials for use as color prints capable of producing dye images that have high fastness to light and will permit only balanced color fading.

2. Prior Art and Its Problems

Conventional photographic materials for use as color prints consist of a reflective support which has successively formed thereon a blue-sensitive silver halide emulsion layer containing a yellow coupler, a first non-light-sensitive intermediate layer, a green-sensitive silver halide emulsion layer containing a magenta coupler, a second non-light-sensitive intermediate layer, a red-sensitive silver halide emulsion layer containing a cyan coupler, and a non-light-sensitive protective layer. To inhibit the fading of dye images upon exposure to light, a UV absorber is incorporated in the first and/or second intermediate layer. But the image keeping quality, especially fastness to light, of the conventional products is far from being satisfactory, and the dye image formed will fade appreciably upon exposure to light. The dye images from the respective couplers vary greatly in the rate of fading (which increases in the order of yellow, magenta and cyan couplers) and the color balance among the respective images will be greatly influenced by exposure to light. This defect is described in prior art references such as British Journal of Photography, 128 (6329), 1170–1171 (1981).

OBJECT OF THE INVENTION

Therefore, the primary object of the present invention is to provide a color photographic material capable of producing dye images that have high fastness to light and will permit only balanced color fading.

As a result of various studies to attain this object, we have found that the desired product can be produced by incorporating a specific UV absorber in a protective layer formed on a cyan emulsion layer on the side opposite the support and by combining said UV absorber with specific cyan, magenta and yellow couplers. The present invention has been accomplished on the basis of this finding.

More specifically, the present invention provides a color photographic material that has formed on a support a first silver halide emulsion layer containing a yellow coupler represented by formula I, a second silver halide emulsion layer containing a magenta coupler represented by formula II, a third silver halide emulsion layer containing a cyan coupler represented by formula IIIa or IIIb, said third emulsion layer being positioned farthest from the support, a first non-light-sensitive layer formed on one side of said third emulsion layer opposite to the support, and a second non-light-sensitive layer formed on the other side of said third emulsion layer, at least said first non-light-sensitive layer containing a UV absorber represented by formula IV:

Formula (I)

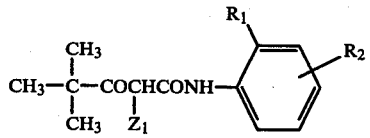

wherein $R_1$ is a hydrogen atom, a halogen atom or an alkoxy group; $R_2$ is $-NHCOR_{21}$, $-NHSO_2R_{21}$, $-COOR_{21}$ or $$-SO_2\underset{\underset{R_{22}}{|}}{N}-R_{21}$$

(wherein $R_{21}$ and $R_{22}$ are each an alkyl group which may be substituted); and $Z_1$ is an atom or a group that is eliminated upon coupling;

Formula (II)

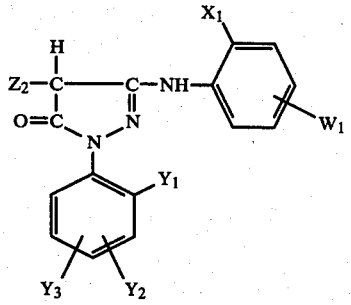

wherein $X_1$ is a hydrogen atom, a halogen atom, an alkyl group, an alkoxy group, an aryloxy group, an amido group, a hydroxy group, a cyano group or a nitro group; $Y_1$, $Y_2$ and $Y_3$ are each a hydrogen atom, a halogen atom, an alkyl group, an alkoxy group, a carboxy group, an alkoxycarbonyl group, a nitro group, an aryloxy group, a cyano group or an acylamino group; $W_1$ is a hydrogen atom, a halogen atom or a monovalent organic group; and $Z_2$ is an atom or a group that is eliminated upon coupling;

Formula (IIIa)

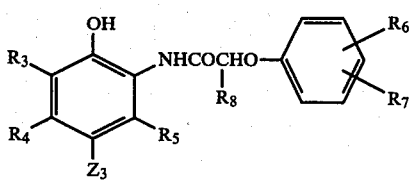

wherein $R_3$, $R_4$ and $R_5$ are each a hydrogen atom, a halogen atom, an alkyl group, an aryl group or an alkoxy group, preferably $R_3$ and $R_5$ each being a hydrogen atom or a halogen atom and $R_4$ being an alkyl group having 1 to 8 carbon atoms. $R_6$ and $R_7$ are each a hydrogen atom, an alkyl group or an alkoxy group, preferably an alkyl group having 1 to 18 carbon atoms; $R_8$ is a hydrogen atom or an alkyl group; and $Z_3$ is an atom or a group that is eliminated upon coupling;

Formula (IIIb)

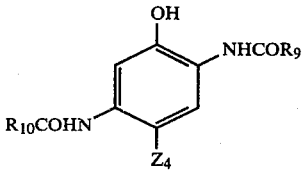

wherein $R_9$ and $R_{10}$ are each an alkyl group, an aryl group or an alkenyl group which may be substituted; and $Z_4$ is an atom or a group that is eliminated upon coupling; and Formula (IV)

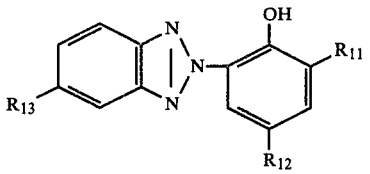

wherein $R_{11}$, $R_{12}$ and $R_{13}$ are each a hydrogen atom, a halogen atom, an alkyl group, an aryl group, an alkoxy group, an aryloxy group, an alkenyl group, a nitro group or a hydroxyl group.

SPECIFIC ELEMENTS OF THE INVENTION

The color photographic material of the present invention (hereunder the word "color" is omitted) has at least two silver halide emulsion layers. In a usual mode, the photographic material has three silver halide emulsion layers having different spectral sensitivities and containing three nondiffusing yellow, magenta and cyan couplers, respectively.

Usually, a red-sensitive silver halide emulsion layer is combined with a cyan coupler, a green-sensitive silver halide emulsion layer with a magenta coupler, and a blue-sensitive silver halide emulsion layer with a yellow coupler. These emulsion layers are formed on a reflective support in the order of the yellow coupler containing layer, the magenta coupler containing layer and the cyan coupler containing layer, or in the order of the magenta coupler containing layer, the yellow coupler containing layer and the cyan coupler containing layer.

The yellow coupler used in the present invention is at least one member of the compounds represented by formula I, wherein $R_2$ is a group represented by —NH-$COR_{21}$, —$NHSO_2R_{21}$, —$COOR_{21}$ or $$-SO_2\underset{\underset{R_{22}}{|}}{N}-R_{21},$$

and $R_{21}$ and $R_{22}$ are each an unsubstituted alkyl group or an alkyl group substituted by a substituted aryloxy group, an alkoxycarbonyl group, an alkylsulfonyl group, a sulfonic acid group, an aryl group, or a substituted alkylamido group. Any known atom or group that is eliminated upon coupling may be selected for $Z_1$. To give a very high fastness to light, $Z_1$ is preferably a nitrogen-containing heterocyclic group having bonds extending from a N atom.

Typical yellow couplers of formula I are listed below:

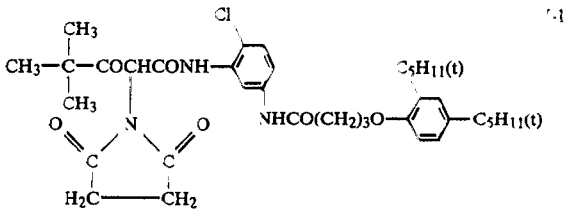

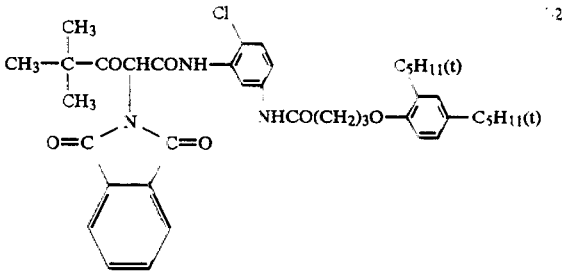

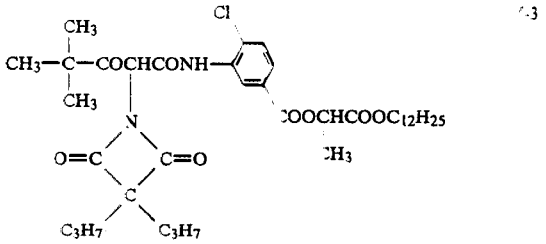

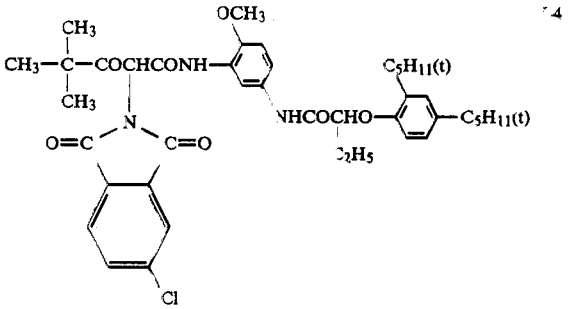

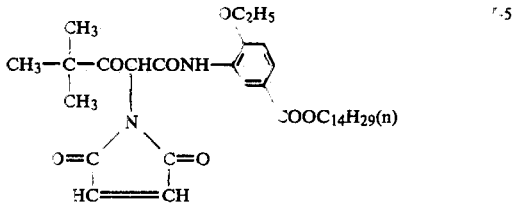

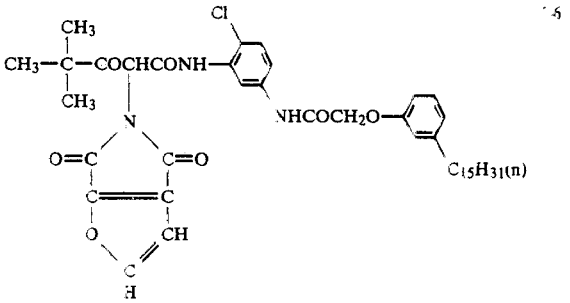

-continued
Y-7
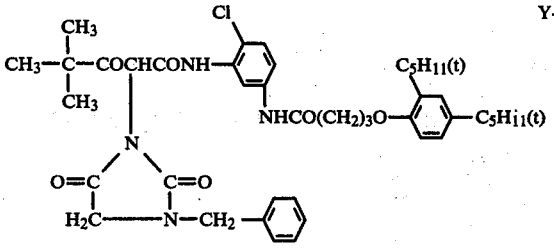
Y-8
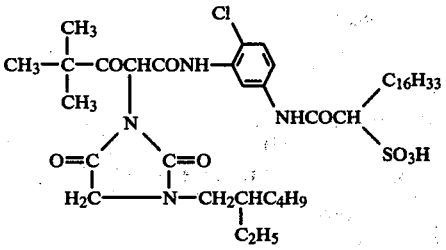
Y-9
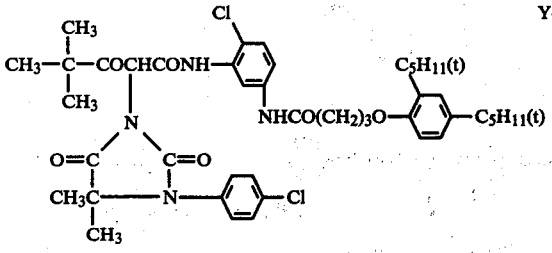
Y-10
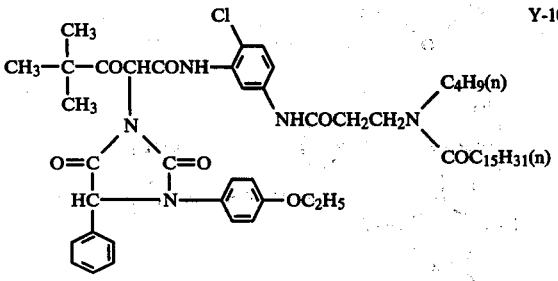
Y-11
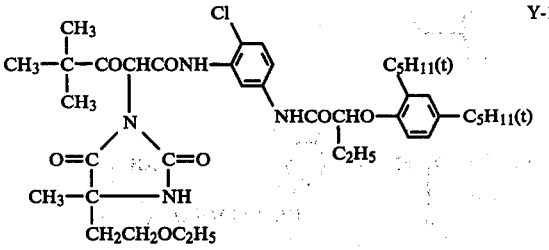
Y-11
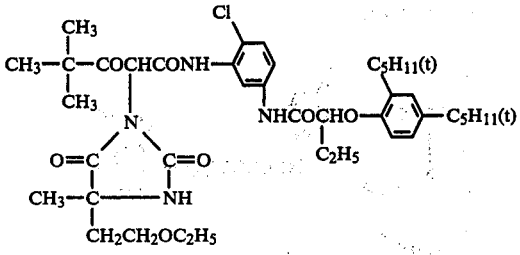
-continued
Y-12
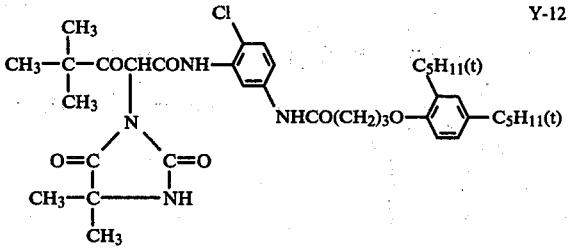
Y-13
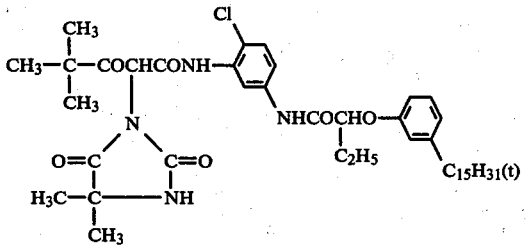
Y-14
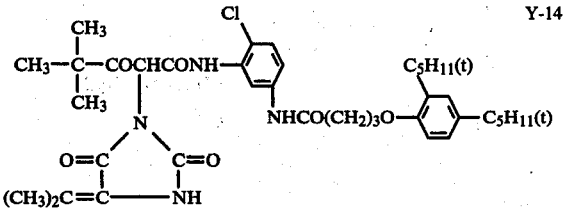
Y-15
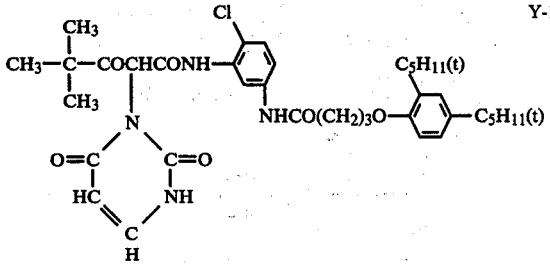
Y-16
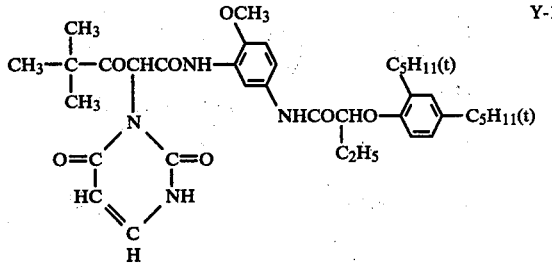
Y-17
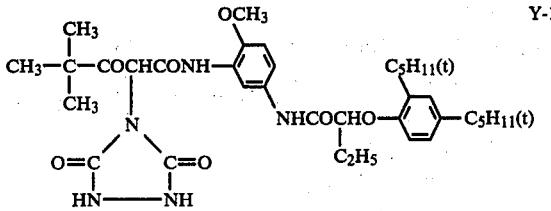

-continued
Y-18
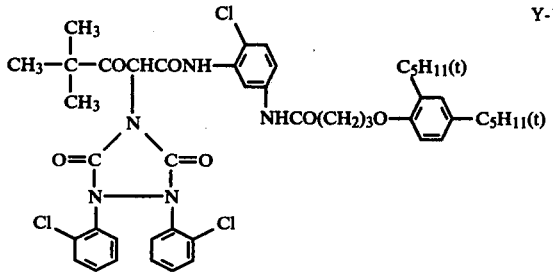
Y-19
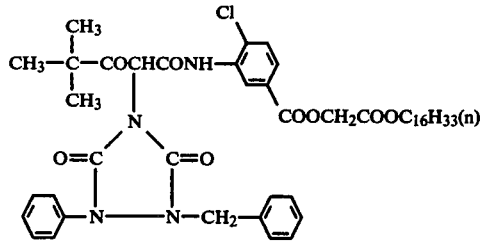
Y-20
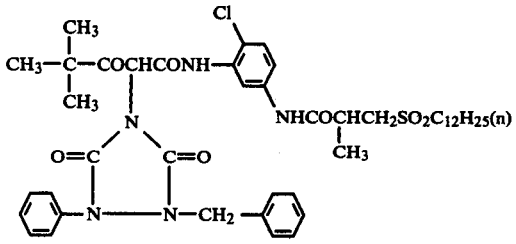
Y-21
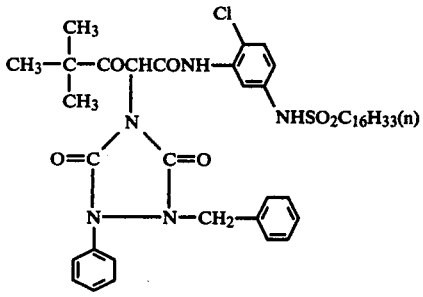
Y-22
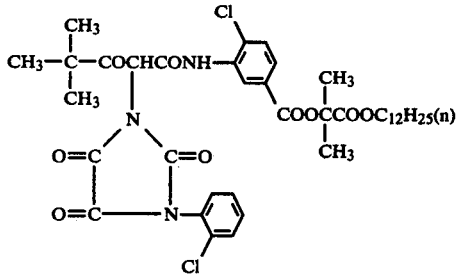
Y-23
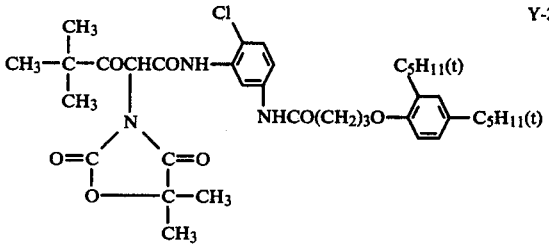
-continued
Y-24
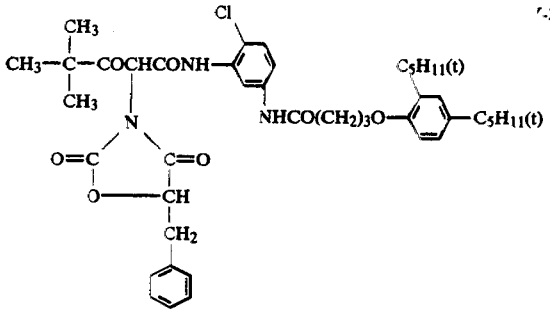
Y-25
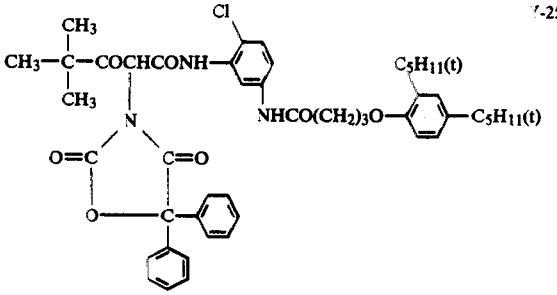
Y-26
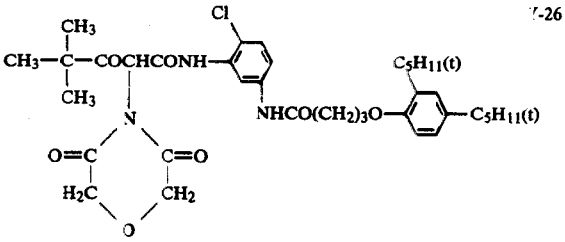
Y-27
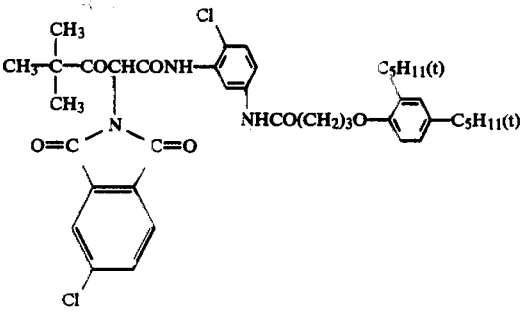
Y-28
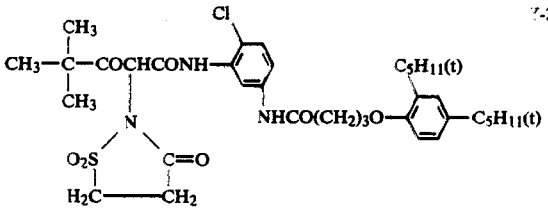
Y-29
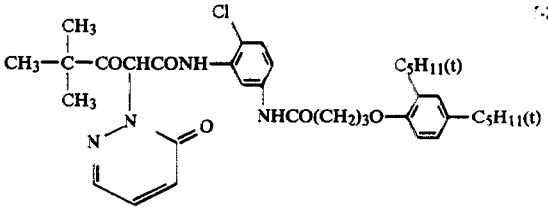

-continued

Y-30

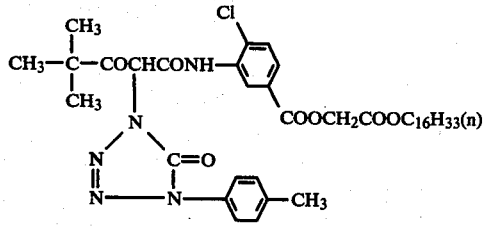

Y-31

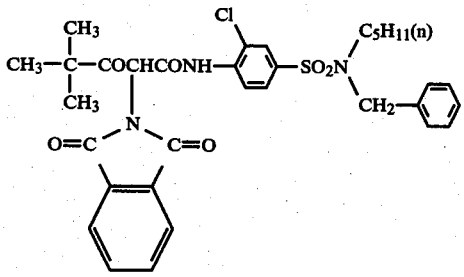

Y-32

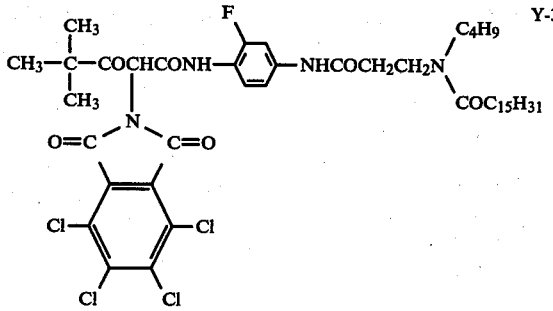

Y-33

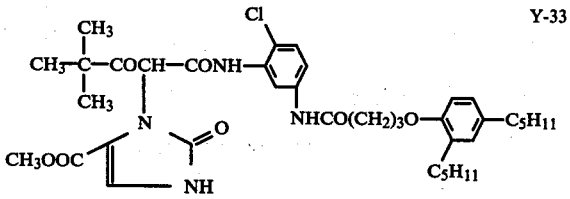

These yellow couplers can be synthesized by any of the methods described in prior art references such as West German Patent Applications (OLS) Nos. 2,0579,941 and 2,163,812; Japanese Patent Applications (OPI) Nos. 26133/72, 29432/73, 65231/75, 3631/76, 50734/76, 102636/76, 66835/73, 94432/73, 1229/74 and 10736/74 (the symbol OPI as used herein means an unexamined published Japanese patent application); Japanese Patent Publications Nos. 33410/76 and 25733/77. The above listed yellow couplers may be used together with other yellow couplers.

The magenta coupler used in the present invention is at least one member of the compounds represented by formula II, wherein $W_1$ represents a hydrogen atom, a halogen atom, or a monovalent organic group. Suitable monovalent organic groups include a nitro group, an alkyl group, an alkoxy group, an acylamino group, a sulfonamido group, as well as optionally substituted alkylcarbamoyl, arylcarbamoyl, alkylsulfamoyl, arylsulfamoyl, alkylsuccinimido, alkoxycarboamido, alkoxycarboalkylamino, aralkoxycarboalkylamino, alkylaminocarboalkylamino, arylaminocarboalkylamino, and aralkylaminocarboalkylamino groups. Any known atom or group that is eliminated upon coupling may be selected for $Z_2$.

Typical magenta couplers of formula II are listed below:

M-1

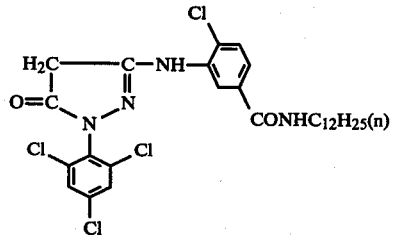

M-2

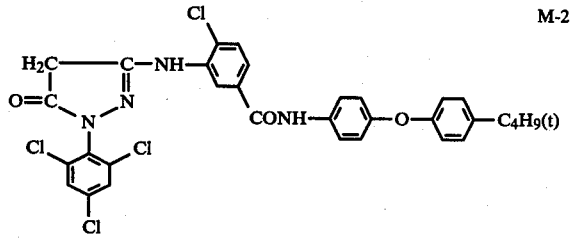

M-3

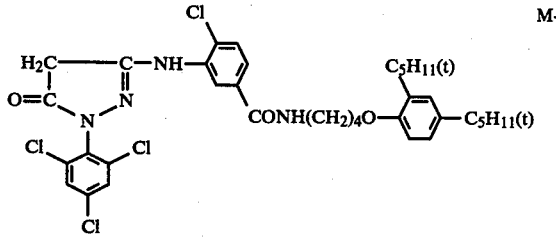

M-4

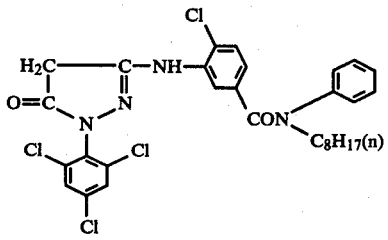

M-5

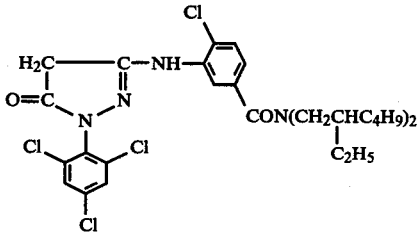

M-6

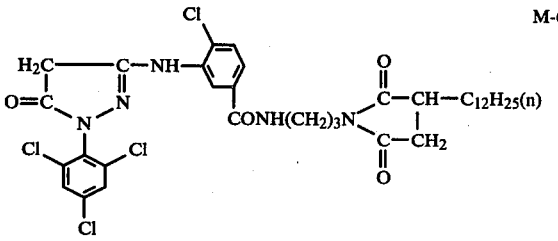

-continued
M-7
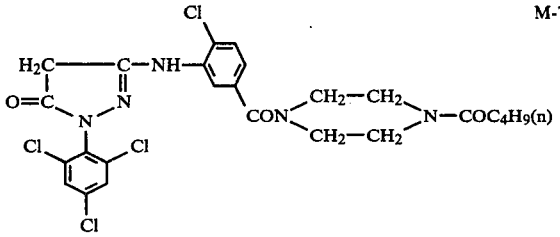
M-8
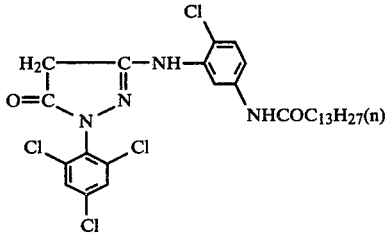
M-9
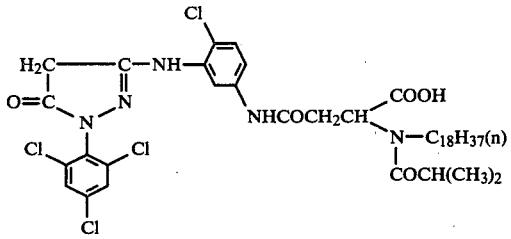
M-10
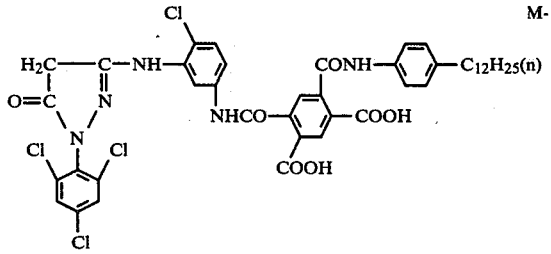
M-11
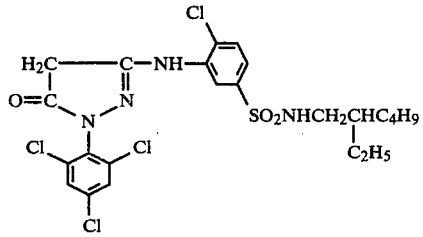
M-12
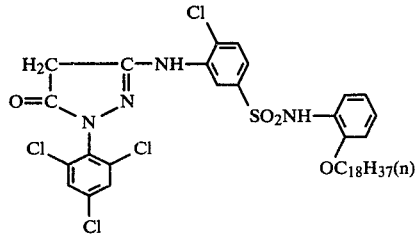
-continued
M-13
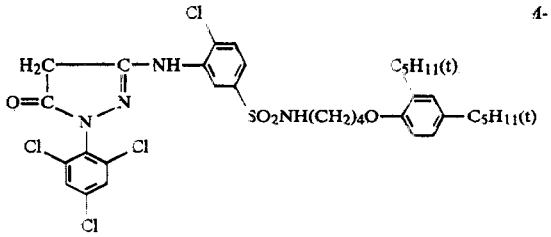
M-14
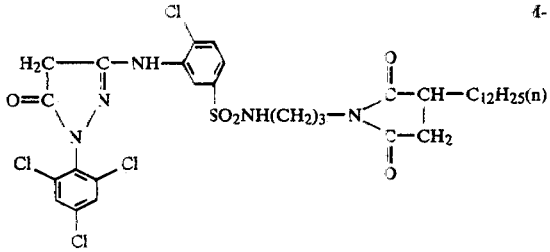
M-15
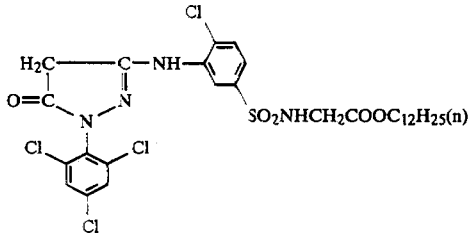
M-16
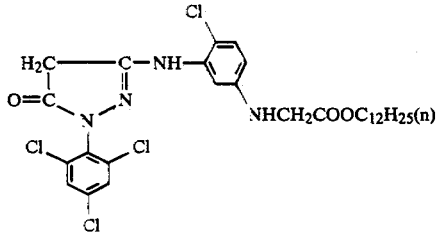
M-17
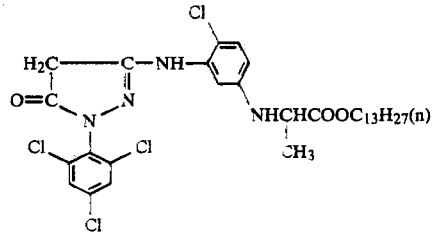
M-18
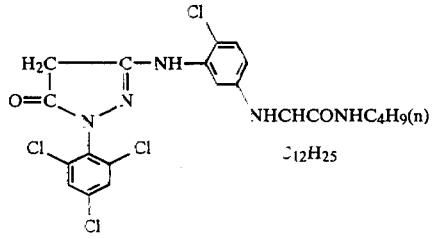

-continued
M-19
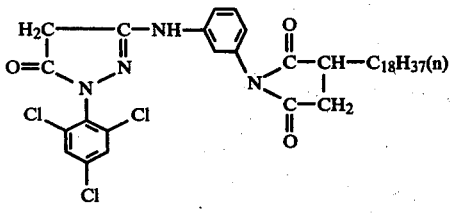
M-20
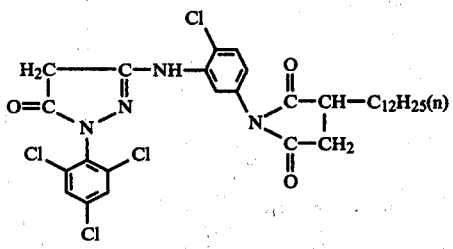
M-21
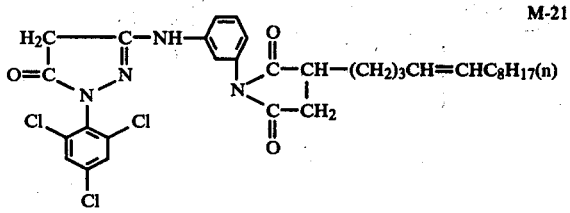
M-22
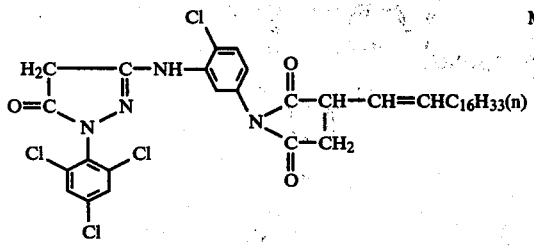
M-23
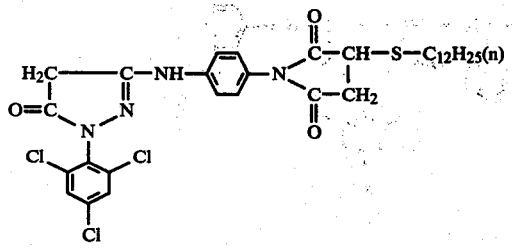
M-24
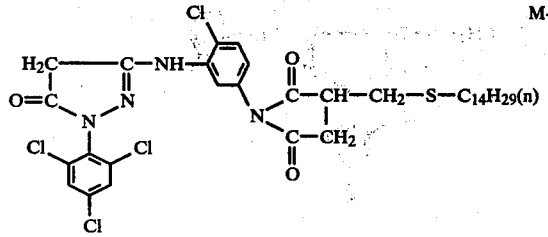
M-25
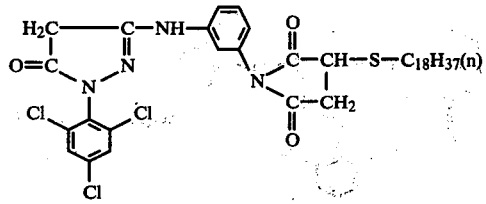
-continued
M-26
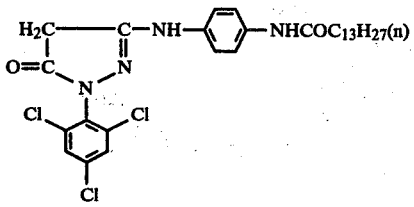
M-27
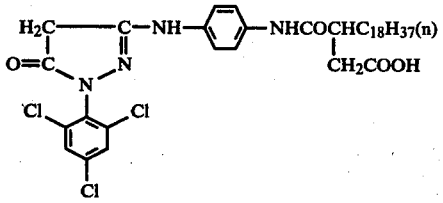
M-28
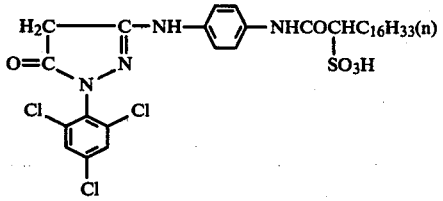
M-29
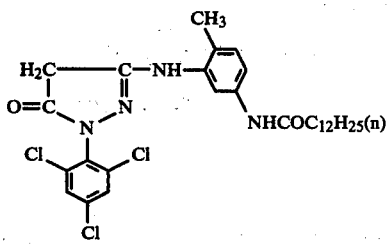
M-30
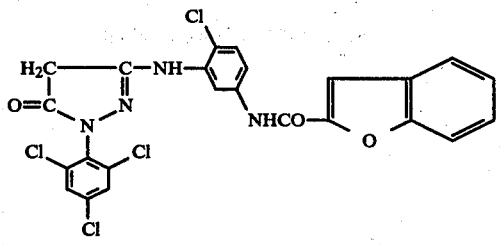
M-31
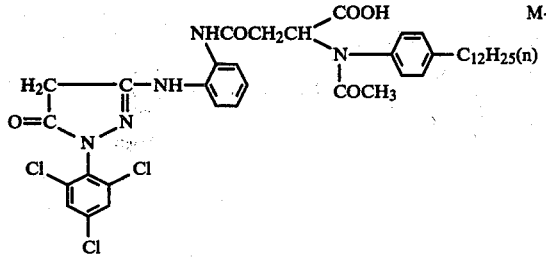
M-32
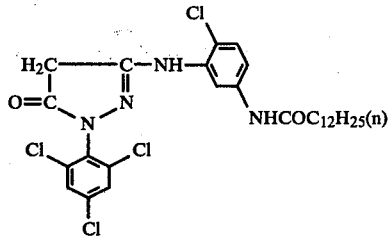

-continued
M-33
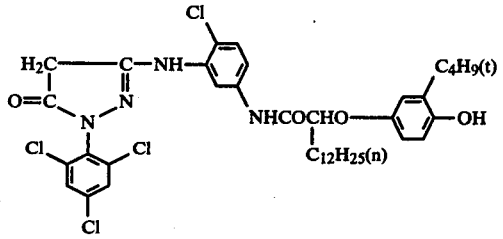
M-34
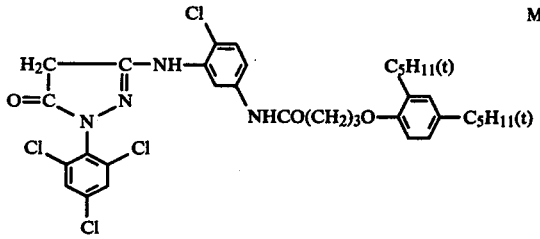
M-35
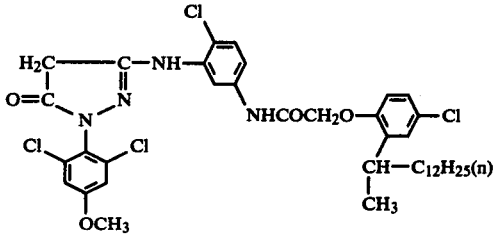
M-36
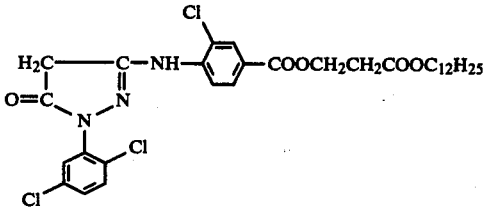
M-37
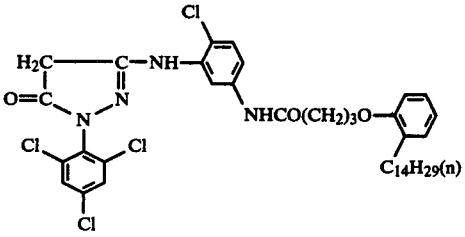
M-38
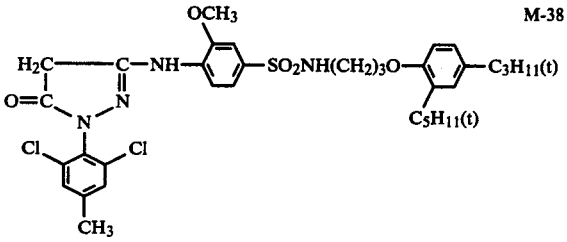
-continued
M-39
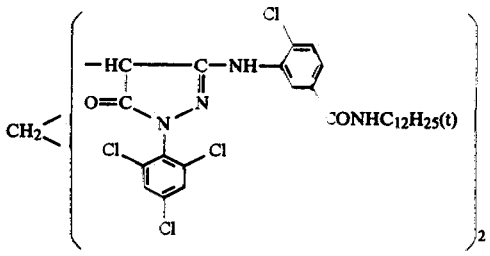
M-40
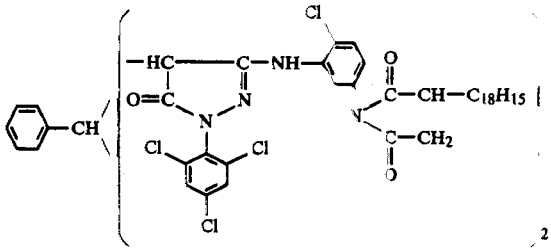
M-41
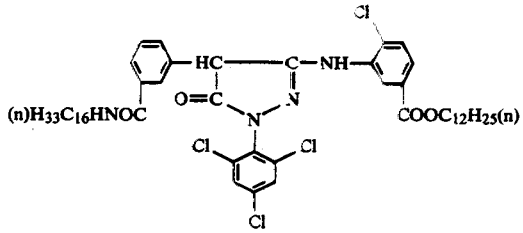
M-42
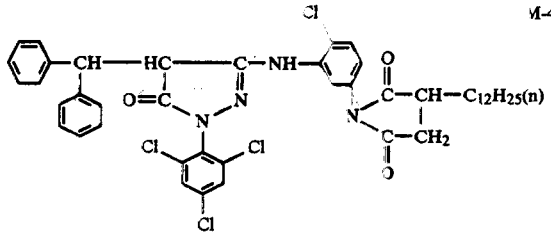
M-43
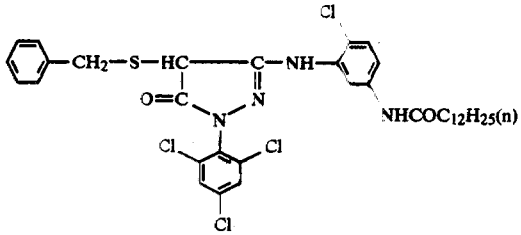
M-44
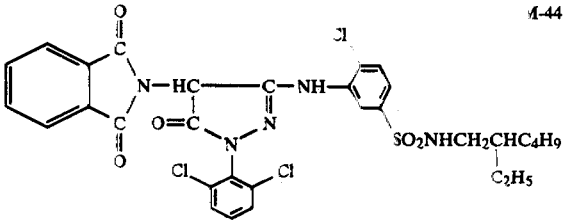

-continued

M-45

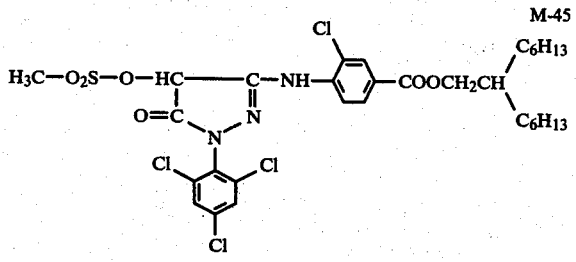

These magenta couplers can be synthesized by any of the methods described in prior art references such as U.S. Pat. No. 3,684,514, British Pat. No. 1,183,515, Japanese Patent Publications Nos. 6031/65, 6035/65, 15754/69, 40757/70, 19032/71, Japanese Patent Applications (OPI) Nos. 13041/75, 129035/78, 37646/76 and 62454/80. The above listed magenta couplers may be used together with other magenta couplers.

The cyan coupler used in the present invention is at least one member of the compounds represented by formula III, wherein $Z_2$ is any known atom or group that is eliminated upon coupling.

Typical cyan couplers of formulas IIIa and IIIb are listed below:

c-1

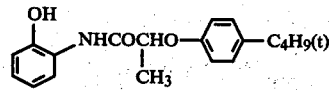

c-2

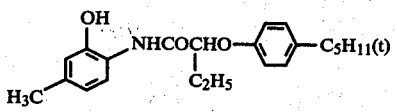

c-3

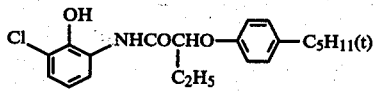

c-4

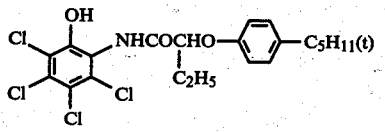

c-5

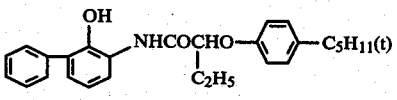

c-6

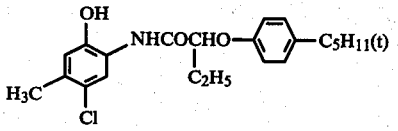

c-7

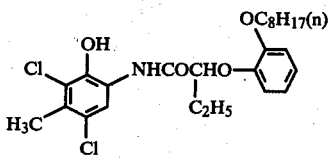

-continued c-8

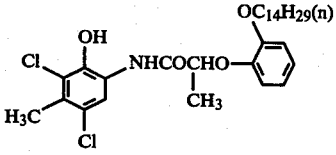

c-9

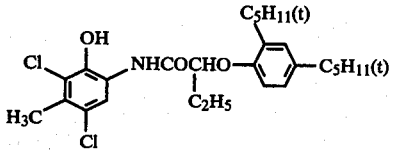

c-10

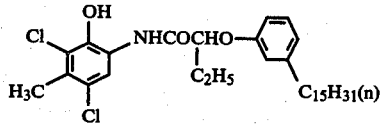

c-11

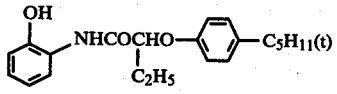

c-12

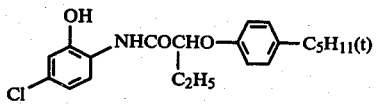

c-13

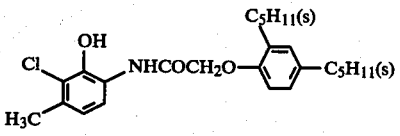

c-14

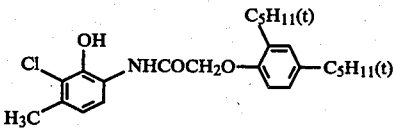

c-15

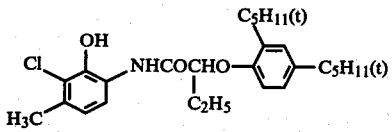

c-16

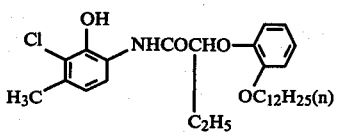

c-17

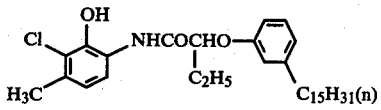

c-18

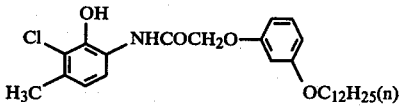

c-19

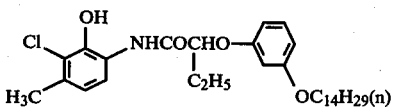

-continued
c-20
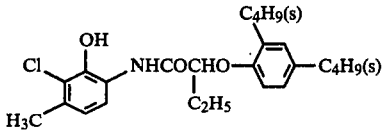
c-21
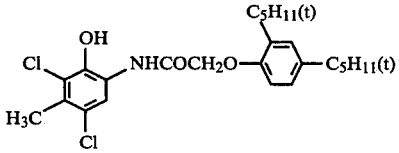
c-22
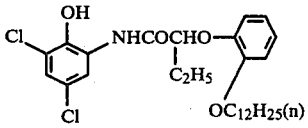
c-23
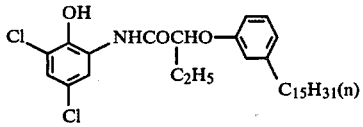
c-24
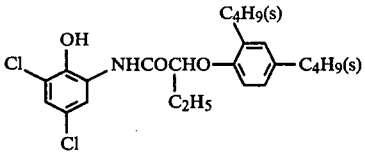
c-25
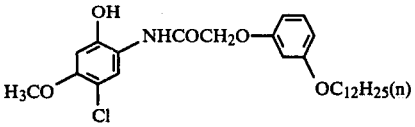
c-26
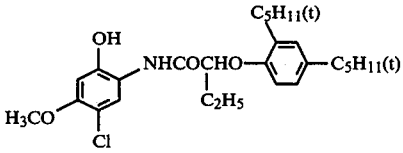
c-27
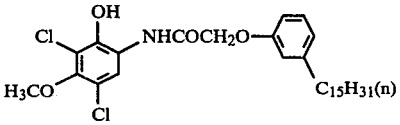
c-28
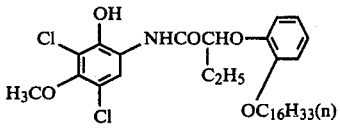
c-29
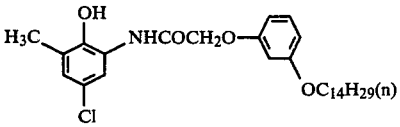
c-30
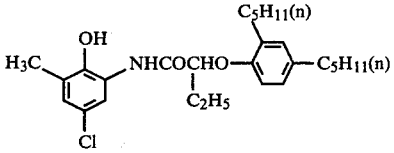
-continued
c-31
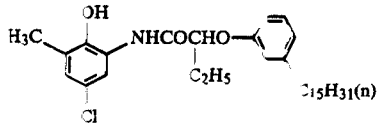
c-32
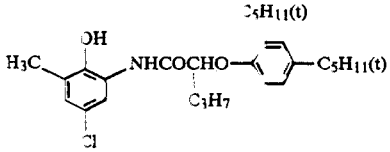
c-33
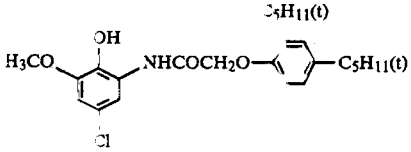
c-34
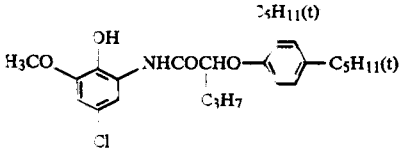
c-35
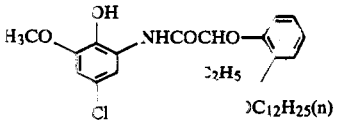
c-36
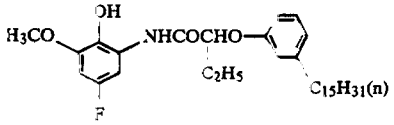
c-37
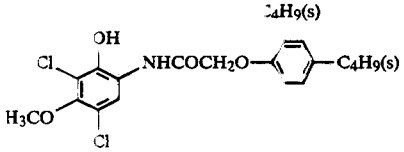
c-38
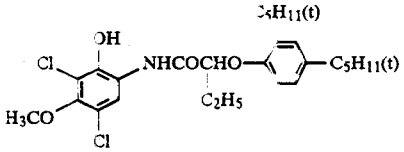
c-39
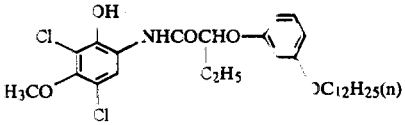
c-40
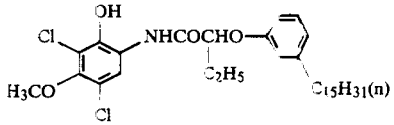

-continued
c-41
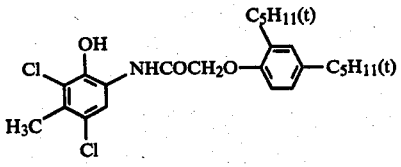
c-42
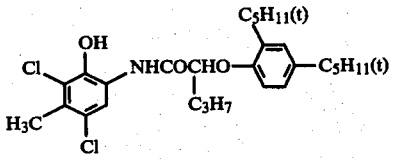
-continued
c-43
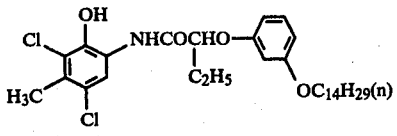
c-44
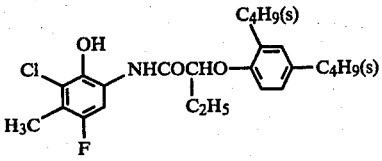
c-45
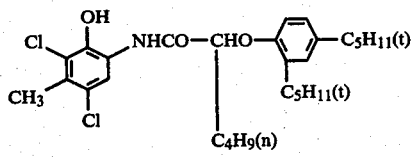

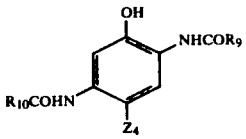
| No. | $R_9$ | $R_{10}$ | $Z_4$ |
|---|---|---|---|
| C-46 | 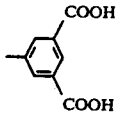 | 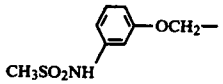 | —H |
| C-47 | 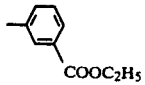 | 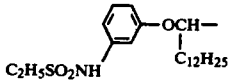 | —H |
| C-48 | $-C_2F_4H$ | 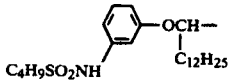 | —OCONH— 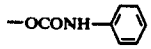 |
| C-49 | 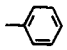 | 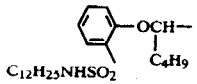 | —H |
| C-50 | 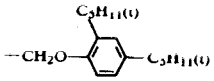 | 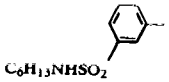 | —H |
| C-51 | 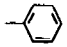 | 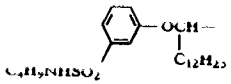 | —Cl |
| C-52 | $-C_3H_7$ | 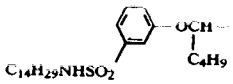 | 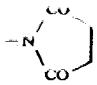 |
| C-53 | 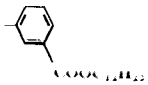 | 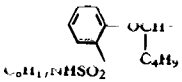 | 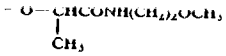 |

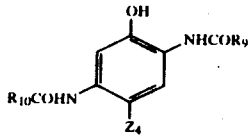
-continued
| No. | $R_9$ | $R_{10}$ | $Z_4$ |
|---|---|---|---|
| C-54 | 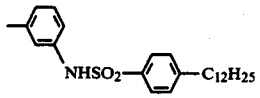 | 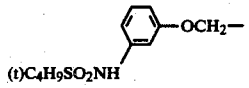 | —H |
| C-55 | 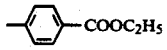 | 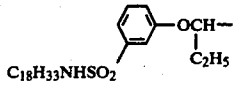 | 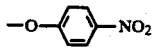 |
| C-56 | —$C_3F_7$ | 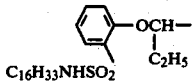 | —H |
| C-57 | 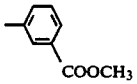 | 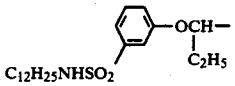 | —Cl |
| C-58 | 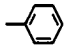 | 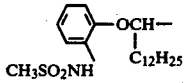 | —H |
| C-59 | 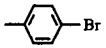 | 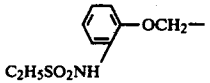 | 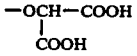 |
| C-60 | 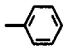 | 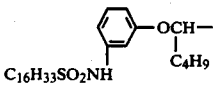 | 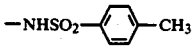 |
| C-61 | —$C_2F_4H$ | 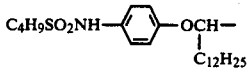 | 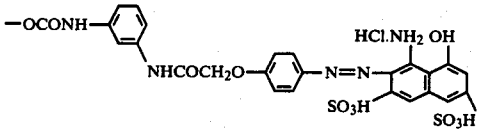 |

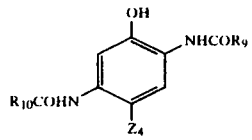
-continued
| No. | $R_9$ | $R_{10}$ | $Z_4$ |
|---|---|---|---|
| C-62 | 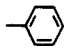 | 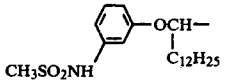 | —Cl |
| C-63 | 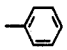 | 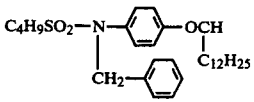 | —Cl |
| C-64 | 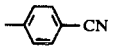 | 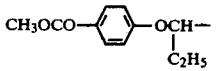 | —H |
| C-65 | $-C_4H_9$ | 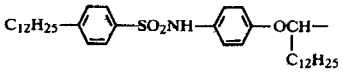 | —Cl |
| C-66 | 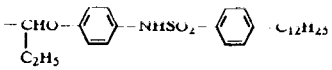 | 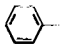 | —Cl |
| C-67 | 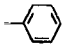 | 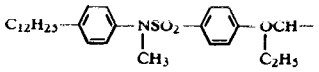 | —H |
| C-68 | $-C(CH_3)_3$ | 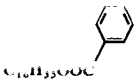 | Cl |
| C-69 | $-C(CH_3)_3$ | 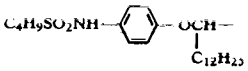 | —Cl |
| C-70 | $-C(CH_3)_3$ | 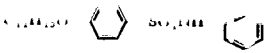 | H |

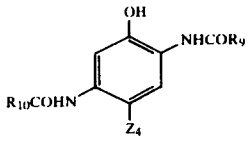
-continued
| No. | $R_9$ | $R_{10}$ | $Z_4$ |
|---|---|---|---|
| C-71 | 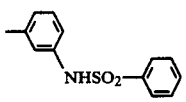 | $C_{12}H_{25}SO_2CH(C_{12}H_{25})-$ | —H |
| C-72 | 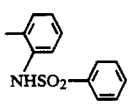 | $(t)C_4H_9-C_6H_4-SO_2CH(C_{12}H_{25})-$ | —Cl |
| C-73 | 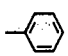 | $(CH_3)_2N-SO_2NH-C_6H_4-OCH(C_4H_9)-$ | —Cl |
| C-74 | 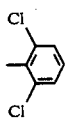 | $(CH_3)_2N-SO_2NH-C_6H_4-OCH(C_{12}H_{25})-$ | —Cl |
| C-75 | 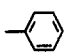 | $C_8H_{17}SO_2NH-C_6H_4-O(OH_2)_3-$ | —Cl |
| C-76 | 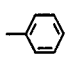 | $C_2H_5O(CH_2)_2SO_2NH-C_6H_4-OCH(C_{12}H_{25})-$ | —Cl |
| C-77 | 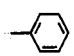 | $CH_3-C_6H_4-SO_2(CH_2)_2SONH-C_6H_3(CH_3)-OCH(C_{12}H_{25})-$ | —H |
| C-78 | $-C_2F_5$ | 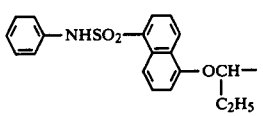 | —H |

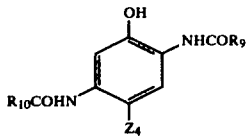
-continued
| No. | $R_9$ | $R_{10}$ | $Z_4$ |
|---|---|---|---|
| C-79 | $-C(CH_3)_3$ | 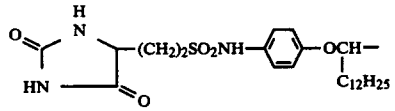 | $-NHSO_2-$  |
| C-80 | $-CH_2(CF_2)_4H$ | 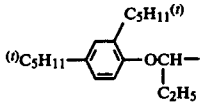 | $-H$ |
| C-81 | $-(CF_2)_3H$ | 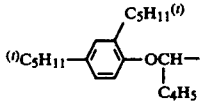 | $-H$ |
| C-82 | 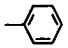 | 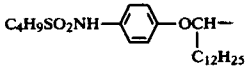 | $-Cl$ |

These cyan couplers may be synthesized by any of the methods described in prior art references such as U.S. Pat. Nos. 2,423,730 and 2,801,171. These cyan couplers may be used together with other cyan couplers.

The yellow, magenta and cyan couplers are generally contained in respective silver halide emulsion layers in amounts of about 0.1 to 1 mol per mol of silver halide.

The first non-light-sensitive layer is formed adjacent and above (on the side opposite the support) the silver halide emulsion layer containing the cyan coupler. The second non-light-sensitive layer is formed adjacent and below (on the same side as the support) the emulsion layer containing the cyan coupler; that is, the second non-light-sensitive layer is formed between the cyan coupler containing emulsion layer and the layer containing the magenta or yellow coupler. The first and second non-light-sensitive layers are made of a hydrophilic binder, say, gelatin. At least the first non-light-sensitive layer contains a benzotriazole UV absorber of formula IV, typical examples of which are listed below:

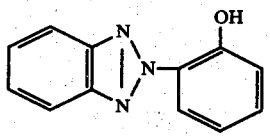
UV-1

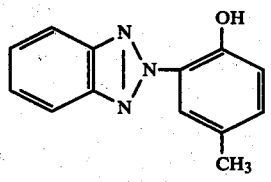
UV-2

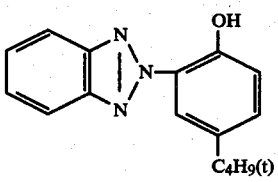
UV-3

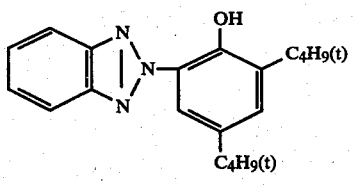
UV-4

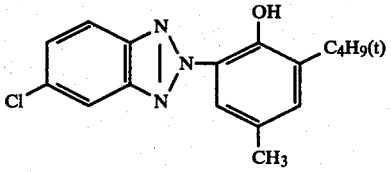
UV-5

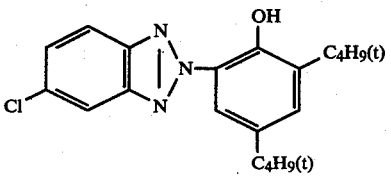
UV-6

-continued

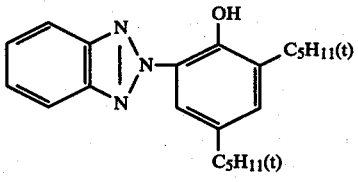
UV-7

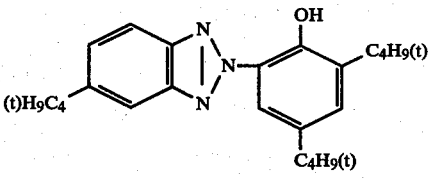
UV-8

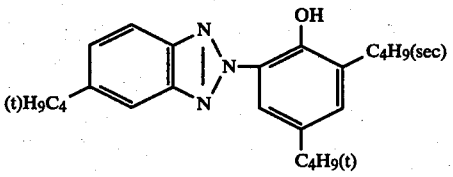
UV-9

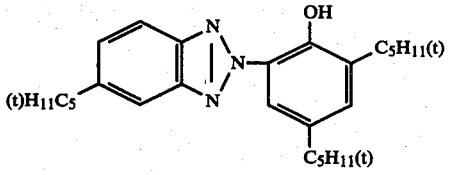
UV-10

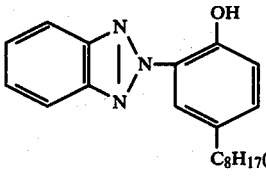
UV-11

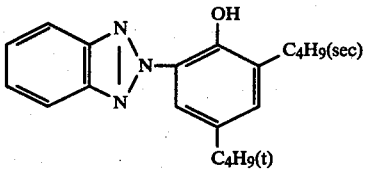
UV-12

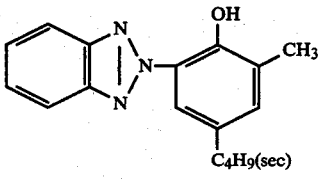
UV-13

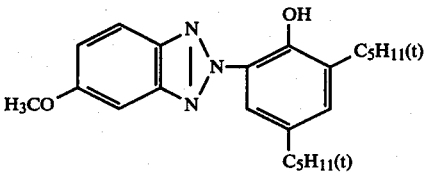
UV-14

-continued

UV-15

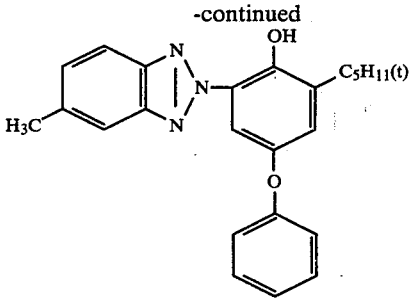

UV-16

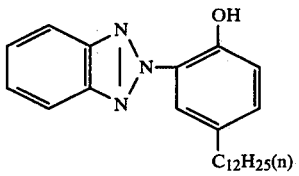

UV-17

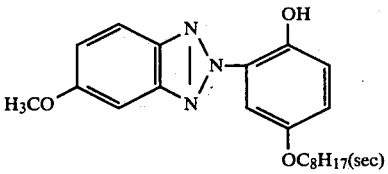

UV-18

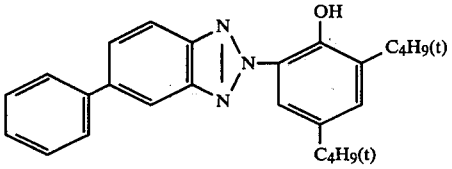

UV-19

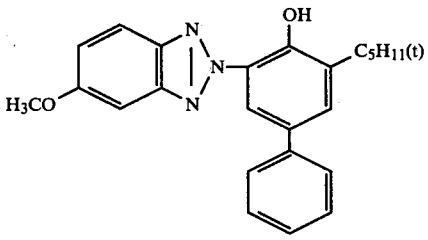

These benzotriazole compounds are described in prior art references such as Japanese Patent Publications Nos. 10466/61, 26187/67, 5496/73, 41572/73, U.S. Pat. Nos. 3,754,919 and 4,220,711. These UV absorbers may be used in combination with other UV absorbers. The UV absorbers of formula IV are generally contained in amounts of about 0.01 to 2 parts by weight per part by weight of the binder in the first non-light-sensitive layer.

The UV absorber of formula IV is preferably incorporated in the second non-light-sensitive layer, as well as in the first non-light-sensitive layer. More preferably, two kinds of said UV absorbers of formula IV are incorporated in combination. The amount of this UV absorber incorporated in the second non-light-sensitive layer should be such that is provides balanced color fading. Usually, it is about 0.1 to 50 times, preferably about 0.5 to 5 times, the amount of the UV absorber contained in the first non-light-sensitive layer.

In the present invention, it is preferable to provide further on the upper side of the first non-light-sensitive layer a third non-light-sensitive layer (preferably made of gelatin) not containing a UV absorber.

A fourth non-light-sensitive layer may be formed between an emulsion layer positioned the closest to the support and an overlying emulsion layer. This fourth non-light-sensitive layer may optionally contain the compound of formula IV or any other UV absorber.

The first, second and third and fourth non-light-sensitive layers may optionally contain an agent to prevent color mixing such as dioctylhydroquinone or dibutylhydroquinone, a whiteness control agent of the type described in Japanese Patent Application (OPI) No. 93150/80, or a coating aid. The first and second non-light-sensitive layers, and optionally the third and fourth non-light-sensitive layers, are made of binder which is usually spread in an amount of about 1 to 30 mg/dm$^2$.

The first non-light-sensitive layer of the present invention preferably contains a brightening agent-mordant. Any brightening agent-mordant may be used if it is capable of mordanting a water-soluble brightening agent. As such brightening agent-mordants, various polymers are usuable such as vinylpyrolidone polymers described in U.S. Pat. Nos. 3,052,544, 3,666,470, 3,167,429, 3,168,403, 3,252,801 and others, pyridine polymers described in U.S. Pat. Nos. 2,448,507, 2,448,508, 2,721,852 and others, morpholine polymers described in U.S. Pat. Nos. 3,341,332 and others, and oxazolidone polymers, polyvinylalcohol polymers and the like described in U.S. Pat. No. 3,006,762 and others. Of these, a polyvinylpyrolidone or a vinylpyrolidone copolymer having a monomer unit of the following structural formula is preferable.

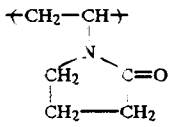

In this case, the mean molecular weight of such polyvinyl pyroliodone or vinylpyrolidone copolymer is not specifically restricted, but is usually from 3,000 to tens of thousands or thereabouts.

As the water-soluble brightening agent to be mordanted by the brightening agent-mordant of the present invention, those in the public domain can be used, each being preferably incorporaged in a processing solution for the photographic material of the present invention. Of these, particularly preferable brightening agents are such diaminostilbene compounds represented by the following formula (V):

Formula (V)

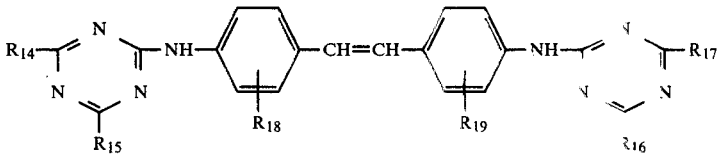

wherein $R_{14}$, $R_{15}$, $R_{16}$ and $R_{17}$ are each a hydrogen atom, a hydroxyl group, a halogen atom, an alkoxy group, an aryloxy group, an alkylthio group, an arylthio group, an alkylamino group, an arylamino group, a sulfo group (including metal salt), a carboxy group (including metal salt) or the like; and $R_{18}$ and $R_{19}$ are each a sulfo group (including metal salt), a carboxy group (including metal salt) or the like.

To make the photographic material of the present invention, the nondiffusing couplers are dispersed in the respective emulsion layers by various methods known as the "dispersion in aqueous alkalies", "dispersion in solid", "dispersion in latex", or "dispersion in oil-in-water emulsion". A suitable method may be selected depending upon the chemical structure of each antidiffusing coupler and other factors. For the purpose of the present invention, the dispersion in latex and dispersion in oil-in-water emulsion are particularly effective. Either method is well known, and the dispersion in latices and the resulting advantages are described in prior art references such as Japanese Patent Applications (OPI) Nos. 74538/74, 59943/76, 32552/79, and Research Disclosure, No. 14850, pp. 77–79, August 1976. Suitable latices are homopolymers, copolymers and terpolymers of monomers such as styrene, ethyl acrylate, n-butyl acrylate, n-butyl methacrylate, 2-acetoacetoxyethyl methacrylate, 2-(methacryloyl) ehtyltrimethylammonium metasulfate, sodium 3-(methacryloyloxy)propane-1-sulfonate, N-isopropylacrylamide, N-[2-(2-methyl-4-oxopentyl)]acrylamide, and 2-acrylamido-2-methylpropanesulfonic acid.

The dispersion in oil-in-water emulsion can be prepared by a known method using a hydrophobic additive such as a coupler. More specifically, the nondiffusing couplers mentioned earlier are dissolved in a high-boiling point solvent such as N-n-butylacetanilide, diethyllauramide, dibutyl phthalate or N-dodecylpyrrolidone, and they are then dispersed in a hydrophilic colloid such as gelatin to form microfine particles of the couplers.

The silver halide emulsion layers in the photographic material of the present invention may contain any of the silver halides conventionally used in silver halide photographic emulsions such as silver chloride, silver bromide, silver iodide, silver chlorobromide, silver iodobromide and silver chloroiodobromide. These silver halides may be in coarse or fine grain form, with either a narrow or broad size distribution. These silver halide grains may be normal crystals or twins, and the ratio of a [100] plane to a [111] plane may assume any value. The crystalline structure of these silver halide grains may be homogeneous throughout, or they may have a heterogeneous structure consisting of distinct outer and inner layers. The silver halide grains may be either surface latent image type or internal latent image type. These silver halide grains may be prepared by any of the known methods commonly employed in the art.

The silver halide emulsions used in the photographic material of the present invention are preferably freed of soluble salts, but they need not be removed if desired. A mixture of separately prepared two or more silver halide emulsions may also be used.

The silver halide emulsion layers or the non-light-sensitive layers may use any of the known binders, and advantageous examples are gelatin and its derivatives such as phenylcarbamylated gelatin, acylated gelatin and phthalated gelatin. A mixture of two or more binders may also be used as required.

The silver halide photographic emulsions having silver halide grains dispersed in binder solutions may be sensitized by chemical sensitizers. Four kinds of chemical sensitizers are used in the present invention with advantage; they are a noble metal sensitizer, a sulfur sensitizer, a selenium sensitizer and a reduction sensitizer. Suitable noble metal sensitizers are gold compounds, as well as ruthenium, rhodium, palladium, iridium and platinum compounds. Gold compounds may be used together with ammonium thiocyanate or sodium thiocyanate. Suitable sulfur sensitizers are activated gelatin and sulfur compounds. Suitable selenium sensitizers are activated and non-activated selenium compounds. Suitable reduction sensitizers include monovalent tin salts, polyamines, bisalkylamino sulfides, silane compounds, iminoaminomethanesulfinic acid, hydrazinium salts and hydrazine derivatives.

The UV absorber may be incorporated in the non-sensitive layers by a known method, wherein the UV absorber is first dissolved in a high-boiling point organic solvent (b.p. ca. 175° C. or higher) optionally together with a low-boiling point solvent, then dispersed in a hydrophilic binder such as aqueous gelatin in the presence of a surfactant, and the resulting dispersion is incorporated in the specific hydrophilic colloidal layer. This method is specifically described below.

Illustrative high-boiling point organic solvents include organic acid amides, carbamates, esters, ketones and urea derivatives. Esters include phthalate esters such as dimethyl phthalate, diethyl phthalate, dipropyl phthalate and dibutyl phthalate; phosphate esters such as trimethyl phosphate, triethyl phosphate tri-propyl phosphate and tri-butyl phosphate; sebacate esters such as dioctyl sebacate, di-(2-ethyl-hexyl)sebacate and diisodecyl sebacate; glycerin esters such as glycerol tripropionate and glycerol tributyrate; as well as adipate esters, glutarate esters, succinate esters, maleate esters, fumarate esters and citrate esters. The UV absorber is dissolved in any of these high-boiling point solvents, optionally together with a low-boiling point solvent such as methyl acetate, ethyl acetate, propyl acetate, butyl acetate, butyl propionate, cyclohexanol, cyclohexanetetrahydrofuran, methyl alcohol, ethyl alcohol, acetonitrile, dimethylformamide, dioxane, methyl ethyl ketone, methyl isobutyl ketone, diethylene glycol, monoacetate, acetylacetone, nitromethane, nitroethane, carbon tetrachloride and chloroform. These high-boiling and low-boiling solvents may be used either independently or as a mixture with themselves. The resulting solution is mixed with an aqueous solution of a hydrophilic binder such as gelatin in the presence of an anionic surfactant such as an alkylbenzenesulfonic acid or an alkylnaphthalenesulfonic acid and/or a nonionic surfactant such as a sorbitan sesquioleate ester or a sorbitan monolaurate ester. The mixture is thoroughly agitated with a high-speed mixer, a colloid mill or an ultrasonic disperser to form an emulsion which is ready for incorporation in the specific hydrophilic colloidal layer.

The photographic material of the present invention may also contain a stabilizer, development accelerator, hardening agent, surfactant, anti-stain agent, lubricant, DIR material, brightening agent, any and other photographic additive. The photographic material of the present invention may also include a back coating in addition to the silver halide emulsion layers and non-sensitive layers.

The reflective support of the photographic material of the present invention may be made of plastics-laminated paper, barytapaper, synthetic paper and any other material that is conventionally used in the art, and a suitable material may be selected depending on the use of the photographic material. These supports may be subjected to various surface preparations to provide a stronger adhesion to the photographic emulsion layers.

PHOTOGRAPHIC PROCESSING OF THE INVENTION

The photographic material of the present invention is exposed through a negative film having an image made of a coupled product, and is then subjected to color development. An ordinary method of color development may be used. First, the exposed photographic material is processed with a solution containing color developing agents. Alternatively, suitable color developing agents or their precursors are preliminarily incorporated in the photographic material, which is subsequently processed with an "activator solution". The developed material is then processed by a conventional technique including bleaching and fixing steps. The color developing step using a developing solution or an activator solution, the bleaching step and the fixing step may be performed either independently, or two or more steps may be effected by a single operation using a monobath having the necessary functions. For example, the color developing step and the bleaching or fixing step may be effected simultaneously with a monobath containing not only the developing solution or activator solution but also the necessary bleaching or fixing agent. Alternatively, the color developing step may be followed by a bleach-fixing step with a blix bath containing both the bleaching and fixing agents.

The processing with the color developing solution or activator solution may be immediately followed by desilvering in the bleaching or fixing bath, or an acidic stopping step may be provided between the developing step and the bleaching or fixing step. A suitable acidic stop bath may be composed of an aqueous solution of acetic acid, citric acid or the like. If necessary, additional steps such as prehardening, neutralization, washing with water and stabilization may be provided. The above procedure produces dye images on the print material as a result of the respective coupling reactions.

Typical color developing agents that can be used with the photographic material of the present invention are aromatic primary amine compounds such as aminophenol or p-phenylenediamine derivatives, which may be used either in a free state or as their salts with hydrochloric acid, sulfuric acid, or organic salts such as p-toluenesulfonic acid, tetraphenylboric acid and p-(t-octyl)-benzenesulfonic acid. Specific aromatic primary amine compounds that can be used as the color developing agent include o-aminophenol, p-aminophenol, 5-amino-2-oxytoluene, 2-amino-3-oxytoluene, 2-oxy-3-amino-1,4-dimethylbenzene, N,N-diethyl-p-phenylenediamine hydrochloride, N-methyl-p-phenylenediamine hydrochloride, N,N-dimethyl-p-phenylenediamine hydrochloride, N-ethyl-N-β-methanesulfonamino-ethyl-3-methyl-4-aminoaniline and sulfate salts thereof, N-ethyl-N-β-hydroxyethylaminoaniline, N,N-diethyl-3-(β-methanesulfonamido-ethyl)-4-aminoaniline hydrochloride, 4-amino-N-(2-methoxyethyl)-N-ethyl-3-methylaniline-p-toluenesulfonate, N-ethyl-N-β-methanesulfon-amindoethyl-3-methyl-4-aminoaniline tetraphenyl borate, 4-amino-N-(2-methoxyethyl)-N-ethyl-3-methylaniline tetraphenyl borate, p-morpholinoaniline, p-piperidinoaniline, and 4-amino-N,N-diethyl-3-chloraniline.

If necessary, the photographic material of the present invention may contain precursors capable of forming the desired color developing agents under alkaline conditions. Illustrative precursors are Schiff base type precursors derived from aromatic aldehyde, polyvalent metal ion complex precursors, precursors derived from phthalimide, precursors derived from phosphoryl amide, precursors made of the reaction product of sugar and amine, and urethane type precursors. These precursors are described in prior art references such as U.S. Pat. Nos. 3,342,599, 2,507,114, 2,695,234, 3,719,492; British Pat. No. 803,783; Japanese Patent Applications (OPI) Nos. 135628/78 and 79035/79; and Research Disclosure Nos. 15159, 12146 and 13924.

The aromatic primary amine compounds as the color developing agent are usually contained in the developing solution in an amount of about 1 to 20 g per liter of the solution.

The color developing solution or activator solution used with the photographic material of the present invention includes an alkali agent such as potassium hydroxide, sodium hydroxide, sodium carbonate, potassium carbonate, sodium tertiary phosphate or potassium tertiary phosphate; a sulfite such as sodium sulfite or potassium sulfite; or a bromide such as sodium bromide, potassium bromide or ammonium bromide. If necessary, the developing solution or activator solution may further contain a known development restrainer; a thiocyanate such as sodium thiocyanate, potassium thiocyanate or ammonium thiocyanate; a chloride such as ammonium chloride, potassium chloride, or sodium chloride; an organic solvent such as ethylene glycol, methanol, ethanol, n-butanol, benzyl alcohol, acetone or dimethylformamide; an amine such as hydroxylamine, ethanolamine, ethylenediamine or diethanolamin; a softening agent such as sodium hexametaphosphate, sodium tripolyphosphate, ethylenediaminetetra-acetic acid or diethylenetriaminepentaacetic acid; or a watersoluble brightening agent.

The color developing solution or activator solution used in the present invention may also contain an auxiliary developing agent. A preferred example is 1-aryl-3-pyrazolidone derivative. The auxiliary developing agent is contained in an amount of 1 mg to 1 g, preferably 10 mg to 500 mg, per liter of the developing solution or activator solution. Typical auxiliary developing agents include 1-phenyl-3-pyrazolidone, 4-methyl-1-phenyl-3-pyrazolidone, 4,4-dimethyl-1-phenyl-3-pyrazolidone, 4-methyl-4-hydroxymethyl-1-phenyl-3-pyrazolidone, and 4-methyl-4-hydroxymethyl-1-(p-tolyl)-3-pyrazolidone.

The color developing solution or activator solution used in the present invention is held alkaline by a conventional method, and the concentration of hydroxyl ions present is properly selected according to the type, formulation, or use of the print material to be processed. Generally, either solution has a pH between 9.5 and 13.5. The color developing solution or activator solution is generally used in a certain temperature range which also varies with the type, formulation and use of the print material. Generally, the temperature ranges from 15° to 70° C., preferably from 30° to 50° C.

Any known compound can be used as a bleaching agent for incorporation in the bleaching bath or blix bath. Suitable examples are ferric complex salts of aminopolycarboxylic acids such as ferric sodium ethylenediaminetetraacetate and ferric ammonium ethylenediaminetetraacetate; and persulfates such as sodium per-sulfate. Any known compound can be used as a fixing agent for incorporation in the fixing bath or blix bath. Suitable examples are thiosulfates such as sodium thiosulfate and ammonium thiosulfate; water-soluble sulfur-containing diols such as 3,6-dithia-1,8-octanediol and 3,6,9,12-tetrathia-1,14-tetradecanediol; and water-soluble sulfur-containing dibasic acids such as ethylene-bis-thioglycolic acid and sodium ethylene-bis-thioglycolate.

ADVANTAGES OF THE INVENTION

The photographic material of the present invention produces dye images that have great fastness to light, and even if they fade upon illumination, most of the initial good color balance is retained. This advantage is achieved only when the yellow, magenta and cyan couplers are combined with the UV absorber as specified hereinabove. As another advantage of the present invention, the fog due to static buildup that may occur during the coating stage or transport through the printer can be prevented very effectively.

The present invention is now described in greater detail by reference to the following examples which are given here for illustrative purposes only and are by no means intended to limit the scope of the invention.

EXAMPLE 1

The following six layers were formed on a reflective support made of polyethylene-coated paper:

| | |
|---|---|
| First Layer | a dispersion of a blue-sensitive silver chlorobromide emulsion and a yellow coupler (0.5 mol/1 mol AgX) |
| Second Layer | an intermediate layer containing a dispersion of 2,5-ditertiary-octyl-hydroquinone |
| Third Layer | a dispersion of a green-sensitive silver chlorobromide emulsion and a magenta coupler (0.3 mol/1 mol AgX) |
| Fourth layer | an intermediate layer containing a dispersion of 2,5-ditertiary-octylhydroquinone and a UV absorber |
| Fifth layer | a dispersion of a red-sensitive silver chlorobromide emulsion and a cyan coupler (0.4 mol/1 mol AgX) |
| Sixth layer | a non-light-sensitive layer containing a dispersion of UV absorber |

For the types and amounts of the respective couplers and UV absorbers, see Table 1 below, wherein the individual couplers and UV absorbers are keyed to their identification numbers listed in the earlier part of the specification. Control yellow coupler Y', magenta coupler M', cyan coupler C', and UV absorber UV' are identified below. For incorporation of the UV absorbers, dibutyl phthalate was used as a high-boiling point solvent. A coating aid and a hardener were added to the respective layers, thereby preparing samples Nos. 1 to 13 of photographic material.

Y'

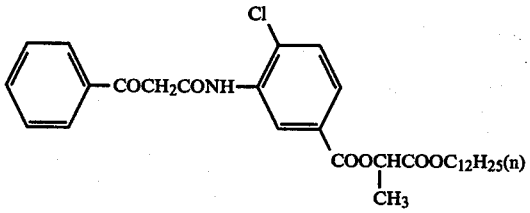

M'

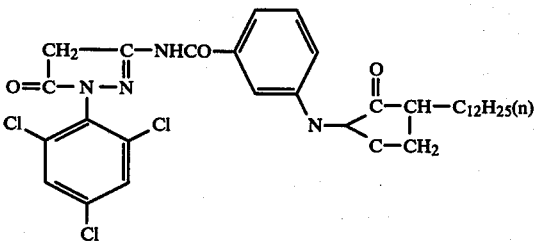

C'

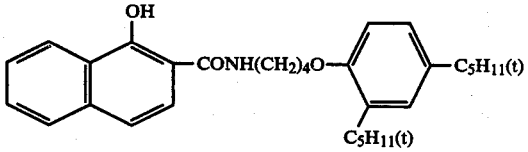

UV'

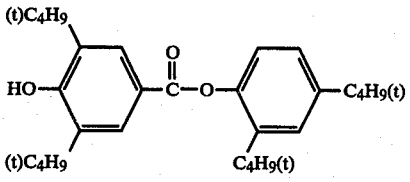

TABLE 1

| Sample No. | | 1st layer | 3rd layer | 4th layer | | 5th layer | 6th layer | |
|---|---|---|---|---|---|---|---|---|
| 1 | | Y-7 | M-19 | UV-7 | 8 mg/dm$^2$ | C-9 | — | — |
| 2 | | Y-7 | M-19 | UV-7 | 5 mg/dm$^2$ | C-9 | UV-7 | 3 mg/dm$^2$ |
| 3 | | Y-7 | M-19 | UV-7 | 8 mg/dm$^2$ | C-9 | UV-7 | 3 mg/dm$^2$ |
| 4 | | Y' | M-19 | UV-7 | 8 mg/dm$^2$ | C-9 | UV-7 | 3 mg/dm$^2$ |
| 5 | comparative samples | Y-7 | M' | UV-7 | 8 mg/dm$^2$ | C-9 | UV-7 | 3 mg/dm$^2$ |
| 6 | | Y-7 | M-19 | UV-7 | 8 mg/dm$^2$ | C' | UV-7 | 3 mg/dm$^2$ |
| 7 | | Y' | M' | UV-7 | 8 mg/dm$^2$ | C' | UV-7 | 3 mg/dm$^2$ |
| 8 | | Y' | M' | UV-7 | 8 mg/dm$^2$ | C' | — | — |
| 9 | | Y-7 | M-19 | UV-7 | 8 mg/dm$^2$ | C-9 | UV' | 3 mg/dm$^2$ |
| 10 | | Y-23 | M-19 | UV-7 | 8 mg/dm$^2$ | C-9 | UV-4 | 3 mg/dm$^2$ |
| 11 | | Y-7 | M-8 | UV-7 | 8 mg/dm$^2$ | C-9 | UV-7 | 3 mg/dm$^2$ |
| 12 | | Y-7 | M-19 | UV-7 | 8 mg/dm$^2$ | C-45 | UV-7 | 3 mg/dm$^2$ |
| 13 | | Y-7 | M-19 | UV-4 | 8 mg/dm$^2$ | C-9 | UV-7 | 3 mg/dm$^2$ |

Samples Nos. 1 to 13 were exposed through an optical wedge and subsequently processed by the following steps to form gray images.

| Steps | Time |
|---|---|
| Color development | 3 min and 30 sec |
| Bleach-fixing | 1 min and 30 sec |
| Washing with water | 3 min and 30 sec |
| Drying | |

| Formulation of color developing solution | |
|---|---|
| N—ethyl-N—β-methanesulfonamidoethyl-3-methyl-4-aminoaniline sulfate | 4.0 g |
| Hydroxylamine sulfate | 2.0 g |
| Potassium carbonate | 25.0 g |
| Sodium chloride | 0.1 g |
| Sodium bromide | 0.2 g |
| Anhydrous sodium sulfite | 2.0 g |
| Benzyl alcohol | 10.0 ml |
| Polyethylene glycol (av. degree of polymerization: 400) | 3.0 ml |
| Water to make | 1,000 ml |
| pH adjusted to 10.0 with sodium hydroxide | |

| Formulation of blix solution | |
|---|---|
| Ferric sodium ethylenediamine-tetraacetate | 60.0 g |
| Ammonium thiosulfate | 100.0 g |
| Sodium bisulfite | 20.0 g |
| Sodium metabisulfite | 5.0 g |
| Water to make | 1,000 ml |
| pH adjusted to 7.0 with sulfuric acid | |
| Redox potential | −70 mV |

The respective samples with gray images were irradiated with a xenone fadeometer for 300 hours, and the fastness to light of the images was tested by measuring the relative change in density (D/Do×100, where D=density after testing and Do=density before testing) against 1.0 (reference value) with a Sakura Color densitometer Model PDA-60 (product of Konishiroku Photo Industry Co., Ltd.). The results are shown in Table 2 below.

TABLE 2

| Sample No. | | Fastness to light (%) Y | M | C |
|---|---|---|---|---|
| 1 | comparative samples | 88 | 86 | 75 |
| 2 | | 89 | 90 | 93 |
| 3 | | 94 | 95 | 95 |
| 4 | | 80 | 93 | 95 |
| 5 | | 92 | 75 | 94 |
| 6 | | 92 | 94 | 82 |
| 7 | | 75 | 70 | 65 |
| 8 | | 70 | 68 | 52 |
| 9 | | 89 | 89 | 79 |
| 10 | | 92 | 94 | 95 |
| 11 | | 93 | 96 | 94 |
| 12 | | 93 | 95 | 92 |
| 13 | | 92 | 93 | 93 |

The data in Table 2 shows that only when the yellow, magenta and cyan couplers of formulas I, II and IIIa or IIIb are combined with the UV absorber of formula IV can the fastness to light of the respective dye images be appreciably increased, with the attendant advantage of balanced color fading.

EXAMPLE 2

Samples Nos. 14 to 19 were obtained by repeating the same procedure as in Example 1 except that, in place of the respective yellow, magenta and cyan couplers as well as the respective UV absorbers used in Example 1, those shown in Table 3 were employed. The thus-prepared Samples Nos. 14 to 19 were exposed to light and treated in the same manner as in Example 1 to form grey images. The respective samples with grey images were then irradiated with a xenone fadeometer for 500 hours, followed by testing the fastness to light of the images in the same manner as in Example 1. The results are shown in Table 4.

TABLE 3

| Sample No. | | 1st layer | 3rd layer | 4th layer | | 5th layer | 6th layer | |
|---|---|---|---|---|---|---|---|---|
| 14 | comparative samples | Y-7 | M-22 | UV-7 | 8 mg/dm² | C-51 | — | |
| 15 | | Y-7 | M-22 | UV-7 | 8 mg/dm² | C-71 | — | |
| 16 | | Y-7 | M-22 | UV-7 | 8 mg/dm² | C-74 | — | |
| 17 | | Y-7 | M-22 | UV-7 | 8 mg/dm² | C-51 | UV-7 | 3 mg/dm² |
| 18 | | Y-7 | M-22 | UV-7 | 8 mg/dm² | C-74 | UV-7 | 3 mg/dm² |
| 19 | | Y-7 | M-22 | UV-7 | 8 mg/dm² | C-74 | UV-7 | |

TABLE 4

| Sample No. | | Fastness to light (%) Y | M | C |
|---|---|---|---|---|
| 14 | comparative samples | 76 | 70 | 72 |
| 15 | | 74 | 73 | 74 |
| 16 | | 75 | 71 | 78 |
| 17 | | 79 | 81 | 80 |
| 18 | | 80 | 78 | 79 |
| 19 | | 79 | 80 | 82 |

The date in Table 4 shows that the color photographic material of the present invention is extremely excellent in the fastness to light of the respective dye images and is also excellent in the color balance of fading.

EXAMPLE 3

Samples Nos. 20 to 27 were obtained by repeating the same procedure as in Example 1 except that, in place of the respective yellow, magenta and cyan couplers as well as the respective UV absorbers used in Example 1, those shown in Table 5 were employed. The thus-prepared Samples Nos. 20 to 27 were exposed to light and treated in the same manner as in Example 1 to form grey images. The respective samples with grey images were then irradiated with a xenone fadeometer for 400 hours, followed by testing the fastness to light of the images in the same manner as in Example 1. The results are shown in Table 6.

TABLE 5

| Sample No. | 1st layer | 3rd layer | 4th layer | | 5th layer | 6th layer |
|---|---|---|---|---|---|---|
| 20 | Y-7 | M-22 | UV-7 | 15 mg/dm² | C-9 | UV-7 |
| 21 | " | " | UV-12 | " | | UV-12 |
| 22 | " | " | (UV-3):(UV-7) = 1:1 | " | | UV-7 |
| 23 | " | " | (UV-4):(UV-7) = 1:1 | " | | (UV-4):(UV-7) = 1:1 |
| 24 | " | " | (UV-5):(UV-7): | " | | (UV-4):(UV-5):(UV-7) |

TABLE 5-continued

| Sample No. | 1st layer | 3rd layer | 4th layer | 5th layer | 6th layer |
|---|---|---|---|---|---|
| 25 | " | " | (UV-8) = 1:1:1 (UV-4):(UV-7) = 1:1 | " | " = 1:1:1 comparative UV-1 |

Note:
The comparative UV-1 used in Sample 25 has the following structure:
Comparative UV-1

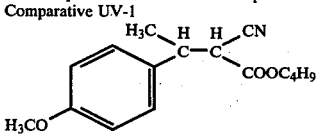

TABLE 6

| Sample No. | Fastness to light (%) Y | M | C |
|---|---|---|---|
| 20 | 56 | 55 | 65 |
| 21 | 56 | 58 | 65 |
| 22 | 56 | 57 | 65 |
| 23 | 62 | 65 | 69 |
| 24 | 62 | 66 | 69 |
| 25 | 36 | 35 | 31 |

The data in Table 6 shows that the effect of the present invention, particularly the fastness to light of magenta dye images, is strikingly improved by using in combination two or more kinds of UV absorbers according to the present invention.

EXAMPLE 4

Samples Nos. 28 to 30 were obtained by repeating the same procedure as in Example 1 except that, in place of the respective yellow, magenta and cyan couplers as well as the respective UV absorbers used in Example 1, those shown in Table 7 were employed and that, except for Sample No. 30, a gelatin layer (seventh layer) has been provided on the sixth layer mensioned in Example 1. The thus-prepared Samples Nos. 28 to 30 were exposed to light and treated in the same manner as in Example 1 to form grey images. The respective samples with grey images were then irradiated with a xenone fadeometer for 400 hours, followed by testing the fastness to light of the images in the same manner as in Example 1. The result are shown in Table 8.

TABLE 7

| Sample No. | 1st layer | 3rd layer | 4th layer | | 5th layer | 6th layer | | 7th layer |
|---|---|---|---|---|---|---|---|---|
| 28 | Y-7 | M-22 | UV-7 | 4.0 mg/dm$^2$ | C-9 | UV-7 | 4.0 mg/dm$^2$ | present |
| 29 | " | " | " | " | " | — | — | present |
| 30 | " | " | " | " | " | UV-7 | 4.0 mg/dm$^2$ | — |

TABLE 8

| Sample No. | Fastness to light (%) Y | M | C |
|---|---|---|---|
| 28 | 62 | 69 | 69 |
| 29 | 53 | 52 | 45 |
| 30 | 60 | 63 | 67 |

The data in Table 8 shows that the fastness to light of dye images, particularly magenta dye images, is strikingly improved by providing a gelatin layer on the first non-light-sensitive layer of the present invention.

What is claimed is:

1. A color photographic material that has formed on a support a first silver halide emulsion layer containing a yellow coupler represented by formula I, a second silver halide emulsion layer containing a magenta coupler represented by formula II, a third silver halide emulsion layer containing a cyan coupler represented by formula IIIa or IIIb, said third emulsion layer being positioned farthest from the support, a first non-light-sensitive layer formed on one side of said third emulsion layer opposite to the support, and a second non-light-sensitive layer formed on the other side of said third emulsion layer, at least said first non-light-sensitive layer containing a UV absorber represented by formula IV:

Formula (I)

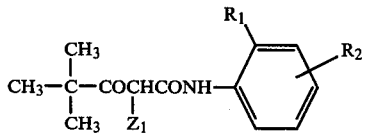

wherein $R_1$ is a hydrogen atom, a halogen atom or an alkoxy group; $R_2$ is $-NHCOR_{21}$, $-NHSO_2R_{21}$, $-COOR_{21}$ or

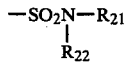

(wherein $R_{21}$ and $R_{22}$ are each an alkyl group which may be substituted); and $Z_1$ is an atom or a group that is eliminated upon coupling;

Formula (II)

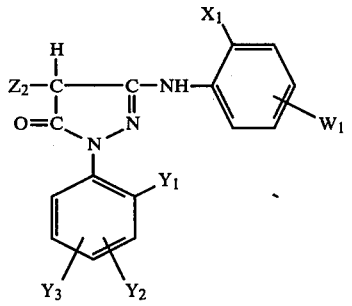

wherein $X_1$ is a hydrogen atom, a halogen atom, an alkyl group, an alkoxy group, an aryloxy group, an amido group, a hydroxy group, a cyano or a nitro group; $Y_1$, $Y_2$ and $Y_3$ are each a hydrogen atom, a halogen atom, an alkyl group, an alkoxy group, a carboxy group, an alkoxycarbonyl group, a nitro group, an aryloxy group, a cyano group or an acylamino group; $W_1$ is a hydrogen atom, a halogen atom or a monovalent organic group; and $Z_2$ is an atom or a group that is eliminated upon coupling;

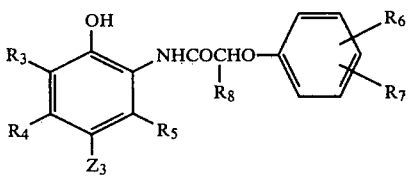

Formula (IIIa)

wherein $R_3$, $R_4$ and $R_5$ are each a hydrogen atom, a halogen atom, an alkyl group, an aryl group or an alkoxy group; $R_6$ and $R_7$ are each a hydrogen atom, an alkyl group or an alkoxy group; $R_8$ is a hydrogen atom or an alkyl group; and $Z_3$ is an atom or a group that is eliminated upon coupling;

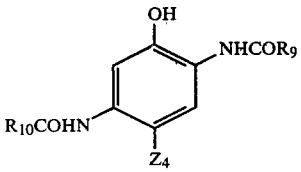

Formula (IIIb)

wherein $R_9$ and $R_{10}$ are each an alkyl group, an aryl group or an alkenyl group which may be substituted; and $Z_4$ is an atom or a group that is eliminated upon coupling; and

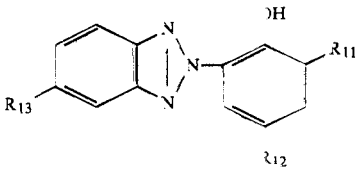

Formula (IV)

wherein $R_{11}$, $R_{12}$ and $R_{13}$ are each a hydrogen atom, a halogen atom, an alkyl group, an aryl group, an alkoxy group, an aryloxy group, an alkenyl group, a nitro group or a hydroxyl group.

2. A color photographic material according to claim 1, wherein said cyan coupler is represented by formula IIIa.

3. A color photographic material according to claim 1, wherein said material further comprises a third non-light-sensitive layer provided on said first non-light-sensitive layer.

4. A color photographic material according to claim 1, wherein said first silver halide emulsion layer, said second silver halide emulsion layer and said third silver halide emulsion layer are provided in this order from the support.

5. A color photographic material according to claim 1, wherein said second non-light-sensitive layer contains said UV absorber.

6. A color photographic material according to claim 1, wherein said first non-light-sensitive layer contains at least two kinds of UV absorbers represented by formula IV.

7. A color photographic material according to claim 3, wherein said third non-light-sensitive layer does not contain said UV absorber.

8. A color photographic material according to claim 7, wherein said first non-light-sensitive layer further contains a brightening agent-mordant.

9. The color photographic material of claim 1, wherein $Z_1$ in Formula (I) is a nitrogen-containing heterocyclic group bonded by a nitrogen atom in said heterocyclic group to the C atom positioned between the two (CO) groups in Formula (I).

* * * * *